United States Patent [19]

Donaldson

[11] Patent Number: 4,994,116

[45] Date of Patent: Feb. 19, 1991

[54] WHEEL DEVICE FOR REMOVING FLUID FROM A FLUID CARRYING CHAIN

[76] Inventor: Thomas W. Donaldson, Balboa, Calif.

[21] Appl. No.: 738,439

[22] Filed: May 28, 1985

[51] Int. Cl.[5] ..... E02B 15/04

[52] U.S. Cl. ..... 134/15; 15/256.52; 210/242.3; 210/923

[58] Field of Search ..... 210/776, 767, 923, 242.2, 210/242.3, 779; 134/9, 15; 15/256.6; 494/92

[56] References Cited

U.S. PATENT DOCUMENTS

| | | | |
|---|---|---|---|
| 769,014 | 8/1904 | Pedley | 198/643 |
| 1,007,282 | 10/1911 | Hawley | 198/643 |
| 1,221,018 | 4/1917 | Bliss | 198/643 |
| 1,245,427 | 11/1917 | Bliss | 198/643 |
| 1,425,112 | 8/1922 | Long | 198/643 |
| 1,475,382 | 11/1923 | Gennevois | 198/643 |
| 1,499,386 | 7/1924 | Long | 198/643 |
| 1,499,387 | 7/1924 | Long | 198/643 |
| 1,703,963 | 3/1929 | Scruby | 198/643 |
| 2,704,981 | 3/1955 | Gustafson | 198/643 |
| 3,762,558 | 10/1973 | Anderson | 210/923 |
| 3,774,685 | 11/1973 | Rhodes | 198/643 |
| 3,812,968 | 5/1974 | Aramaki et al. | 210/923 |
| 3,968,041 | 7/1976 | DeVoss | 210/242.3 |
| 4,002,491 | 1/1977 | Esparza | 134/6 |
| 4,123,354 | 10/1978 | Williams | 210/242.2 |

*Primary Examiner*—Anthony McFarlane
*Attorney, Agent, or Firm*—Lyon & Lyon

[57] ABSTRACT

A fluid carrying chain is drawn between the interface of circumferentially abutting wheel members having pockets in the circumferential edge faces thereof configured to the shape of the link members of the chain such that each link member becomes snugly enveloped in its own chamber thereby expelling fluid from the link member.

7 Claims, 1 Drawing Sheet

WHEEL DEVICE FOR REMOVING FLUID FROM A FLUID CARRYING CHAIN

BACKGROUND OF THE INVENTION

The field of the present invention is the recovery of fluid from fluid carrying chains.

Chains and other conveyor means have been used as a fluid carrying medium to transport fluids such as oil or water from a fluid source to a remote deposit situs. Various methods have been suggested to remove the transported fluid at the destination point. When conveyor means other than chains are implemented, fluids may be removed by such methods as squeegee rolls in Rhodes U.S. Pat. No. 3,774,685, scrapers in Pedley U.S. Pat. No. 769,014, and presser wheels in Hawley U.S. Pat. No. 1,007,282 and Scruby U.S. Pat. No. 1,703,963. When chains are employed, fluids may be removed by such methods as metal scrappers in Gustafson U.S. Pat. No. 2,704,981, slit sheets in Purviance U.S. Pat. No. 181,475, centrifugal force means in Gennevois U.S. Pat. No. 1,475,382, Long U.S. Pat. Nos. 1,425,112, 1,489,386, and 1,499,387, and gravity means in Bliss U.S. Pat. Nos. 1,221,018 and 1,245,427.

The instant invention improves upon such suggestions by providing two uniquely configured wheels to actively remove fluid from a chain.

SUMMARY OF THE INVENTION

This invention relates to a wheel device for removing oils over a wide range of specific gravity from a chain used to recover oil from wells.

When oil is recovered from a well using a chain it is desirable to remove as much oil from the chain as possible before it returns to the well to accumulate more oil. While gravity, centrifugal force, or other methods may suffice when fluidal oils are present, those methods may be inefficient when the oil is viscous. When scrapers or slit materials are used to remove oil much of the oil can remain on the chain depending on chain geometry. In those cases, alternate methods of oil removal must be employed.

It is therefore an object of this invention is to provide improved means for removing oil from a chain used to recover oil from wells.

It is a further object of this invention to provide removal means for removing viscous oil from a chain.

It is still yet a further object of this invention to provide increased oil extracting capacity in a chain used to recover oil from wells.

Other objects and advantages will be readily apparent from the following description.

DESCRIPTION OF THE PREFERRED EMBODIMENT

Figure 3:
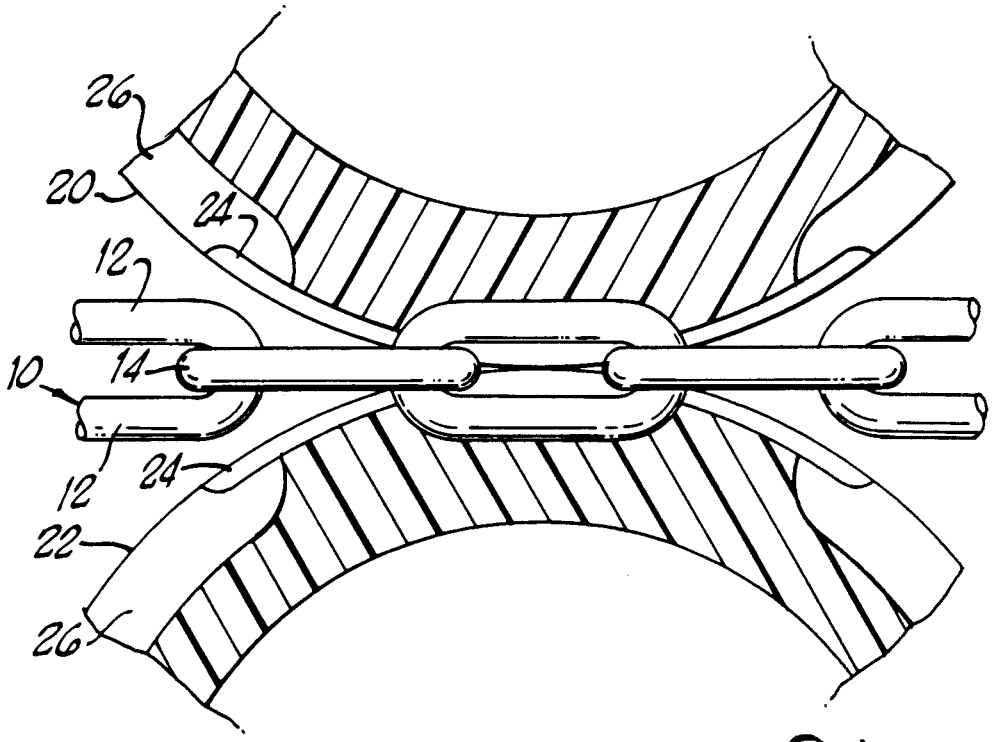
FIG. 3 is a cutaway view of a wheel-chain interface.
Figure 1:
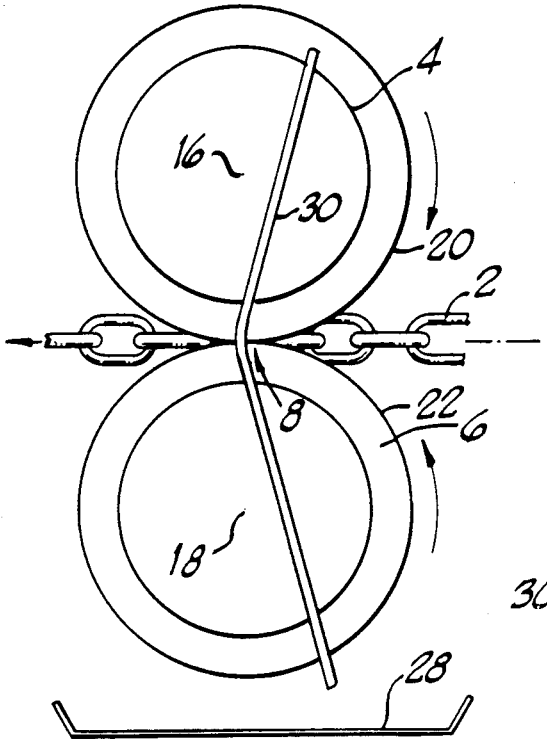
FIG. 1 is a side elevation of a system embodying the present invention.

Referring to FIGS. 1, and 3, chain 2 is drawn between circumferentially abutting oil recovery wheels 4 and 6 at wheel-chain interface 8. Chain 2 is comprised of individual chain link members 10 having sides 12 and ends 14. Oil recovery wheels 4 and 6 may be constructed from any suitably durable material such as metal or elastomeric materials such as rubber or the like.

The wheels revolve about parallel axes 16 and 18, respectively, which are positioned such that the oil recovery wheels fit rim to rim, providing a tight grip on chain 2 at wheel-chain interface 8.

Figure 2:
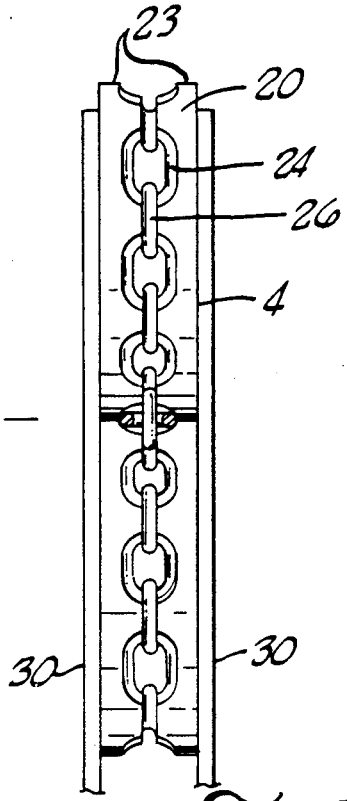
FIG. 2 is an end view of an oil recovery wheel.

Referring to FIGS. 2 and 3, circumferential edge faces 20 and 22 of oil recovery wheels 4 and 6 have a flat portion 23 and pocket portions 24 and 26 configured to the shape of chain link members 10. For link members aligned with their sides 12 contacting both oil recovery wheels, pockets 24 are provided. For link members aligned with each side 12 contacting only one oil recovery wheel, pockets 26 are provided. By placing oil recovery wheels 4 and 6 rim to rim, with the flat portions 23 thereof abutting, and with pockets 24 and 26 on wheel 4 lined up with pockets 24 and 26 on wheel 6, each chain link passing through the wheel-chain interface will be enveloped in a discrete chamber formed by the opposing pockets.

Because each link fits snugly in its chamber, there is no room for the oil carried thereon and this excess is expelled from the chain. As the oil is expelled it is directed to a recovery trough 28 by wiper strips 30 positioned immediately adjacent the sides of wheels 4 and 6, extending from the upper portion of wheel 16 through interface 8 and ending below wheel 6.

While what hereinbefore has been described is the preferred embodiment of this invention, it is readily apparent that alterations and modifications can be resorted to without departing from the scope of this invention and such alterations and modifications are intended to be included within the scope of the appended claims.

What is claimed is:

1. A device for removing fluid from a fluid carrying chain comprising:

a first rotatable wheel member having a circumferential face, pockets in said edge face configured to the shape of link members of the fluid carrying chain, a second rotatable wheel member having the circumferential face geometry of said first rotatable wheel member, positioned so that the faces of said wheel members are abutting and so that said pockets line up to form enclosed chambers for said link members.

2. The device set forth in claim 1 further comprising wiper strips positioned adjacent the sides of said wheel members to scrape expelled chain fluids from said wheel members.

3. The device set forth in claim 2 wherein said faces are made from elastomeric material.

4. A device for removing fluid from a fluid carrying chain comprising:

circumferentially abutting rotatable wheel members having a circumferential interface, said interface comprising a flat surface portion and a chamber portion wherein said chamber portion is configured to accept and envelop individual chain link members of the fluid carrying chain as said chain is drawn through said interface.

5. A method for removing fluid from a fluid carrying chain comprising the steps of:

placing the chain between the interface of two circumferentially, abutting wheel members wherein the circumferential faces of said wheel members have pockets configured to the shape of the link members of said chain and wherein said pockets line up to form chambers to envelop said link members, pulling said chain through said interface to rotate said wheel members whereby said fluid is removed from the chain by said wheel members, scraping removed oil from said wheel members and directing said fluid into a fluid collecting vessel.

6. A device for removing fluid from a fluid carrying chain comprising:

a pair of wheel members revolvable about parallel axes and having a circumferential interface, said interface being configured to receive the fluid carrying chain for removing fluid therefrom.

7. A device for removing fluid from a fluid carrying conveyor comprising:

a pair of wheel members having a circumferential interface, said interface having a chamber portion configured to accept and envelop said conveyor as said conveyor is drawn through said interface.

* * * * *